US012416296B2

(12) United States Patent
Todman

(10) Patent No.: US 12,416,296 B2
(45) Date of Patent: Sep. 16, 2025

(54) PISTON TYPE PUMP DRIVE ARRANGEMENT

(71) Applicant: ZF CV Systems Europe BV, Brussels (BE)

(72) Inventor: Peter Todman, Upper Poppleton York (GB)

(73) Assignee: ZF CV SYSTEMS EUROPE BV, Brussels (BE)

( * ) Notice: Subject to any disclaimer, the term of this patent is extended or adjusted under 35 U.S.C. 154(b) by 790 days.

(21) Appl. No.: 17/612,600

(22) PCT Filed: May 21, 2019

(86) PCT No.: PCT/EP2019/063110

§ 371 (c)(1),
(2) Date: Nov. 19, 2021

(87) PCT Pub. No.: WO2020/233796

PCT Pub. Date: Nov. 26, 2020

(65) Prior Publication Data

US 2022/0235750 A1 Jul. 28, 2022

(51) Int. Cl.

| | |
|---|---|
| ***F04B 9/04*** | (2006.01) |
| ***F04B 1/0426*** | (2020.01) |
| ***F04B 1/053*** | (2020.01) |
| *F04B 39/00* | (2006.01) |
| *F04B 53/14* | (2006.01) |

(52) U.S. Cl.
CPC ..... *F04B 9/045* (2013.01); *F04B 1/0426* (2013.01); *F04B 1/053* (2013.01); *F04B 9/047* (2013.01);

(Continued)

(58) Field of Classification Search
CPC ..... F04B 9/045; F04B 1/0426; F04B 1/053; F04B 9/047; F04B 39/0005; F04B 53/147;

(Continued)

(56) References Cited

U.S. PATENT DOCUMENTS 10,704,542 B2 * 7/2020 Bredbeck ..... F04B 39/0027
2015/0078932 A1 * 3/2015 Ruiz Martinez ..... F04B 9/04 417/341

(Continued)

FOREIGN PATENT DOCUMENTS

CN 201228620 Y 4/2009
CN 103282656 A 9/2013

(Continued)

OTHER PUBLICATIONS

Raw Machine Translation of of JPS62153581 (A)—Aug. 7, 1987 "Reciprocating Compressor"; Yasuhisa et al.*

*Primary Examiner* — Mark A Laurenzi
*Assistant Examiner* — Lilya Pekarskaya
(74) *Attorney, Agent, or Firm* — LEYDIG, VOIT & MAYER, LTD.

(57) ABSTRACT

A piston type pump includes a pump housing having a pump inlet, a pump outlet, and a piston arrangement connected to a drive shaft. The drive shaft is configured to drive the piston arrangement, and the drive shaft includes a first eccentric. The piston arrangement has a first primary stage piston connected to a first sliding block guide slidably seated on the first eccentric. The first sliding block guide has a main axis, a minor axis, and an inner surface. A first sliding bush is arranged between the first eccentric and the first sliding block guide. The outer surface of the first sliding bush corresponds to the inner surface of the first sliding block guide. Translational movement of the first sliding bush relative to the first sliding block guide is allowed along the main axis and restricted along the minor axis.

13 Claims, 12 Drawing Sheets

(52) U.S. Cl.
CPC ..... *F04B 39/0005* (2013.01); *F04B 53/147* (2013.01)

(58) Field of Classification Search
CPC ..... F04B 1/02; F04B 27/005; F04B 27/053; F04B 35/01; F04B 39/0094; F04B 53/006; F04B 39/121; F04B 39/123; F04B 39/125
See application file for complete search history.

(56) References Cited

U.S. PATENT DOCUMENTS

| | | | | |
|---|---|---|---|---|
| 2016/0169216 | A1* | 6/2016 | Okuno | F04B 39/14 92/73 |
| 2017/0211557 | A1 | 7/2017 | Schmidt | |
| 2017/0350249 | A1 | 12/2017 | Rafalski et al. | |
| 2018/0266406 | A1* | 9/2018 | Bredbeck | F04B 27/005 |
| 2020/0309103 | A1* | 10/2020 | Todman | F04B 27/02 |
| 2021/0293229 | A1 | 9/2021 | Meissner et al. | |

FOREIGN PATENT DOCUMENTS

| | | | |
|---|---|---|---|
| CN | 108026910 | A | 5/2018 |
| EP | 1574709 | A2 | 9/2005 |
| JP | S62153581 | A | 7/1987 |
| JP | 2006220074 | A | 8/2006 |
| JP | 2016113907 | A | 6/2016 |
| WO | WO 2017137141 | A1 | 8/2017 |
| WO | WO 2017137144 | A1 | 8/2017 |

* cited by examiner

PISTON TYPE PUMP DRIVE ARRANGEMENT

CROSS REFERENCE TO RELATED APPLICATIONS

This application is a U.S. National Phase application under 35 U.S.C. § 371 of International Application No. PCT/EP2019/063110, filed on May 21, 2019. The International Application was published in English on Nov. 26, 2020 as WO/2020/233796 A1 under PCT Article 21(2).

FIELD

The present disclosure relates to a piston type pump, comprising a pump housing having at least one pump inlet and one pump outlet and a piston arrangement connected to a drive shaft which, when driven, sets the piston arrangement into movement, wherein the drive shaft comprises a first eccentric, and the piston arrangement comprises a first primary stage piston connected to a first sliding block guide slidably seated on the first eccentric, said first sliding block guide having a main axis, a minor axis and an inner surface. Such pumps may be used to induce a vacuum at the pump inlet and/or to provide pressurized fluid at the pump outlet.

BACKGROUND

Vacuum pumps are for example known from WO 2017/137144 A1 or WO 2017/137141 A1. Such vacuum pumps are generally referred as piston type vacuum pumps in distinction from so-called rotary vane vacuum pumps. Piston type pumps include at least one piston which reciprocatingly moves inside a cylinder. The pump inlet usually is connected with the working chamber formed by the cylinder such that when the piston moves inside the cylinder for increasing the working volume of the working chamber the vacuum is induced at the inlet. A first piston rod of a first piston is driven by a drive shaft of the pump and performs a combined linear and pendulum motion. A second piston rod of the pumps is rotatable connected to the first piston rod via a connecting bolt and thus also performs a combination of a linear and a pendulum motion. However, the drive assembly of such pumps requires close manufacturing tolerances and comprises multiple parts, resulting in increased time for assembly and increased manufacturing cost. Furthermore, the non-rectilinear movement of the pistons might lead to increased wear on the piston and/or cylinder of the pump. Pumps of this type are used in passenger vehicles or trucks as in particular vacuum pumps to supply specific modules of the vehicle with a vacuum. Generally manufacturing cost and good wear characteristics are of utmost importance for pumps used in vehicles.

A drive assembly of a compressed fluid motor, which provides a linear piston motion is presented in US 2017/0350249 A1. Pistons of said motor drive an output shaft via a crank pin. A rolling bearing positioned on the crank pin is slidably supported in between guide plates connected to respective piston rods of the pistons. During operation of said motor, the crank pin is rotated through a linear movement of the guide plates, wherein the outer ring of said rolling bearing slides relative to the guide plates and thereby eliminating a rocking motion of the piston rods. However, the presented drive assembly still comprises multiple parts requiring close manufacturing tolerances and therefore increasing a required time for assembly as well as manufacturing cost. Furthermore, the pistons are not fixed rotationally to the crank pin which can lead to irregular wear on piston seals. Moreover, drive assemblies are known, wherein a crank pin directly interacts with a guide slot without a bearing. While such assemblies may have fewer components highly accurate machining of the parts is necessary, in order to provide acceptable vibrational and noise levels.

SUMMARY

In an embodiment, the present disclosure provides a piston type pump. The piston type pump includes a pump housing having a pump inlet, a pump outlet, and a piston arrangement connected to a drive shaft. The drive shaft is configured to drive the piston arrangement, and the drive shaft includes a first eccentric. The piston arrangement has a first primary stage piston connected to a first sliding block guide slidably seated on the first eccentric. The first sliding block guide has a main axis, a minor axis, and an inner surface. A first sliding bush is arranged between the first eccentric and the first sliding block guide. The outer surface of the first sliding bush corresponds to the inner surface of the first sliding block guide. Translational movement of the first sliding bush relative to the first sliding block guide is allowed along the main axis and restricted along the minor axis.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
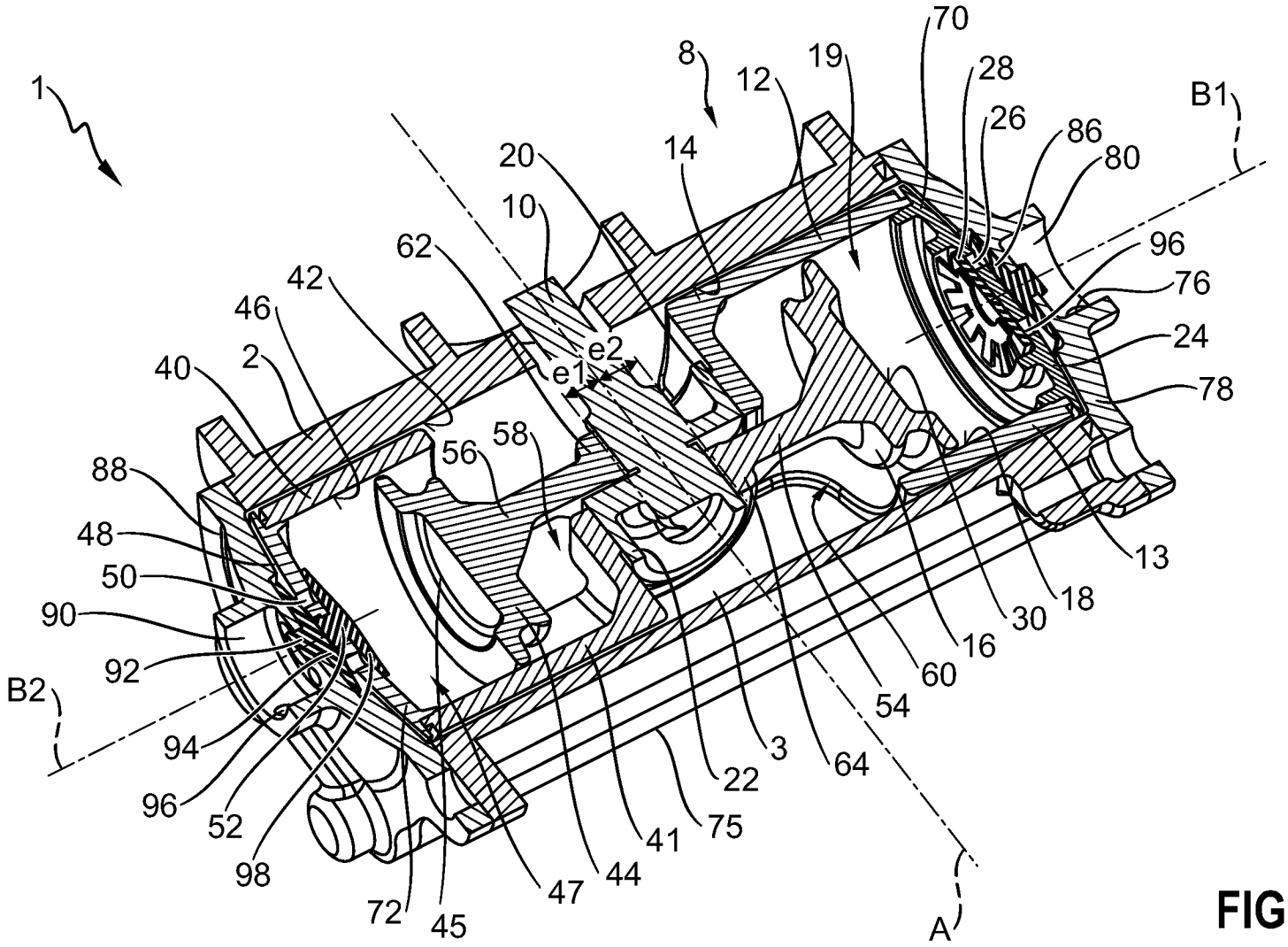
FIG. 1 shows a perspective simplified cut view of a piston type pump comprising an eccentric and sliding block guide drive arrangement.
Figure 2:
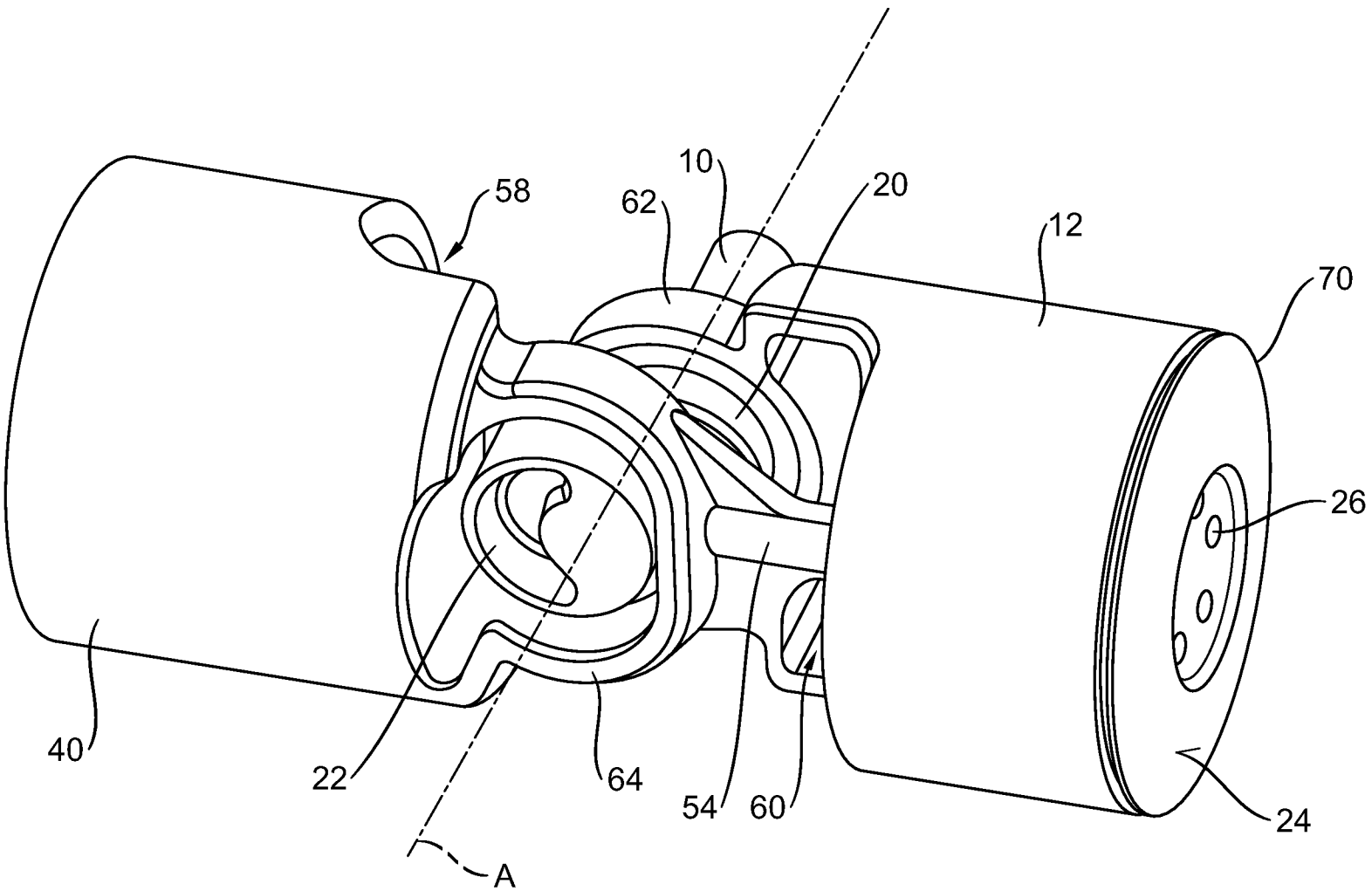
FIG. 2 shows a simplified perspective view of a piston arrangement of a piston type pump comprising an eccentric and sliding block guide drive arrangement.

The present disclosure provides a piston type pump which allows for reduced manufacturing cost, improved wear characteristics, compact design and/or low noise emissions.

The present disclosure provides for a first sliding bush arranged between a first eccentric and a first sliding block guide, such that an outer surface of said first sliding bush corresponds to said inner surface of the first sliding block guide and that translational movement of said first sliding bush relative to said first sliding block guide is allowed along a main axis and restricted along a minor axis. The inner surface of said first sliding block guide forms a slot, wherein the first eccentric and the first sliding bush are located. The first sliding bush comprises an inner bore which is positioned on a corresponding outer surface of the first eccentric. Preferably, the first eccentric is rotatable in the first sliding bush about a rotational axis, which is parallel to a rotational axis of the drive shaft. A first direction of the first eccentric forms its central axis which is parallel to the rotational axis of the drive shaft und performs an orbital motion around said rotational axis when the drive shaft is driven. The first sliding bush is slidably seated in the first sliding block guide such that movement of the sliding bush relative to the first sliding block guide is allowed along the main axis. The main axis of the sliding block guide is perpendicular to said rotational axis of the drive shaft. Preferably, the main axis is perpendicular to a cylinder axis of a first primary stage cylinder, which corresponds to the first primary stage piston. The minor axis of the first sliding block guide is perpendicular to the said rotational axis as well as the main axis. It is preferred that the minor axis is parallel or coaxial to the cylinder axis of the first primary stage cylinder. Movement of the first eccentric along the main axis results in a sliding motion of the eccentric and the first sliding bush along the inner surface of the sliding block guide. When the first eccentric and the first sliding bush move parallel to the minor axis a relative motion between the sliding guide block and the sliding bush is restricted and a motion of the first eccentric is transferred to the first sliding block guide via the first sliding bush. Thus, an orbital motion of the eccentric around the rotational axis of the drive shaft is converted to a rectilinear motion of the first sliding block guide parallel to the minor axis. The sliding bush allows for minimum friction between the first sliding block guide and the first sliding bush and/or between the first sliding bush and the first eccentric. A first material forming the first sliding bush is preferably one of carbon filled polymers, PTFE, ABS, PEEK, Nylon, PPS, Xylonite, fiber reinforced plastics, bronze, ceramics and/or white metal.

Furthermore, the first material forming the first sliding bush can have a hardness that is lower than a hardness of a material forming the eccentric and/or the first sliding block guide. The first sliding bush can compensate for existing manufacturing deviations of the first sliding block guide and/or the first eccentric and thus allows for lower manufacturing costs of said components. Preferably the first sliding block guide and the first primary piston are integrally formed. For example, the first primary piston, the first sliding block guide, and a first piston rod connecting the first primary piston and the first sliding block guide can be casted in one piece. Casting production allows for low manufacturing costs at high quantities but in general reachable manufacturing tolerances are low. The rough tolerances can be compensated by the sliding bush and thus lower manufacturing costs can be achieved. It should be understood that the disclosure is not limited to casted first sliding block guides. Rough tolerances can also result from other manufacturing methods such as milling, turning, casting and/or additive manufacturing. In order to reduce manufacturing cost and time or to improve process stability rough tolerances are often accepted.

Preferably, said inner surface of the first sliding block guide comprises a first inner wall parallel to said main axis and a second inner wall parallel to said main axis and spaced from said first inner wall by a slot width. A first dimension of the sliding bush perpendicular to the first direction, thus a dimension along the minor axis of the sliding block guide, is smaller or equal to said slot width such that the sliding bush can be placed in between the first and second inner wall. For example, the outer surface of the sliding bush can have a rectangular cross-section, wherein a first side of the sliding bush is parallel to said first inner wall of the sliding block guide and a second side of the sliding bush is parallel to said second inner wall of the sliding block guide. Preferably, the first inner wall and the second inner wall of said first sliding block guide are symmetrical to a plane perpendicular to the minor axis.

In a preferred embodiment of the piston type pump said outer surface of the first sliding bush is tapered along a first direction parallel to a rotational axis of said drive shaft towards a first end of said drive shaft and said inner surface of the first sliding block is correspondingly tapered along the first direction towards said first end. Thus, the first sliding bush becomes gradually smaller along the first direction starting from an end of the drive shaft opposite to the first end towards said first end. Preferably a first dimension of the first sliding bush, which is measured parallel to the minor axis, gradually becomes smaller, while a second dimension of the first sliding bush, which is perpendicular to the first dimension and the first direction, may stay constant. Accordingly, a free inner surface or slot width of the first sliding block guide gradually becomes smaller starting form said opposite end of the drive shaft towards the first end of the drive shaft. Thus, a width of the slot, measured parallel to the minor axis gradually decreases along the first direction. A minimum width of the slot is larger than a diameter of the first eccentric. The inner surface of the first sliding block guide and the outer surface of the first sliding bush are tapered correspondingly such that the inner surface of the first sliding block guide forms a negative of the corresponding outer surface of said first sliding bush. Preferably there is surface contact between said inner surface of the first sliding block guide and said outer surface of the first sliding bush and gaps are reduced or eliminated. Gaps often result in unwanted noise levels, increased wear and/or stability problems of the pump and therefore should be reduced or eliminated. The inner surface and/or outer surface can taper at a constant rate and/or can be variable. For example, the first sliding bush can be shaped as a truncated cone or bell wherein the inner surface of said first sliding block guide resembles a surface line of said cone or bell. In a particularly preferred embodiment the first sliding bush comprises four perpendicular sides forming the outer surface, wherein two opposing sides of said four sides are tapered and the two remaining sides are not tapered. Due to manufacturing tolerances an inner width of said inner surface of the first sliding block guide is variable and gaps between said first sliding bush and said first sliding block guide may exist. By tapering the inner and outer surface, areal contact between the first sliding bush and the first sliding block guide can be achieved by relative movement of the first sliding bush and the first sliding block guide parallel to the rotational axis of said drive shaft. Increased wear resulting from line contact as well as gaps can be avoided. A first axial length of said inner surface of the first sliding block guide, measured along the first direction, can be smaller than or equal to a corresponding second axial length of said outer surface of the first sliding bush. Preferably said first axial length is 50% to 100%, particularly preferred 70% to less than 100%, of said second axial length. Thus, the first sliding bush protrudes from the first inner surface at one or two sides.

In another preferred embodiment the first sliding bush is biased towards said first end of said drive shaft by a first biasing member, such that said outer surface of the first sliding bush contacts said inner surface of the first sliding block guide. A first tapered end of the first sliding bush and a first tapered end of the first sliding block guide are oriented towards said first end of the drive shaft. Thus, the first sliding bush is continuously pushed into the inner surface or slot of the first sliding block guide and areal surface contact can be ensured. During operation of the pump the first sliding bush slides relative to the first sliding block guide and wear occurs on contacting surfaces of the first sliding bush and the first sliding block guide. The slot width of the first sliding block guide increases while at least a first dimension of the first sliding bush is decreased. Hence, gaps between the first sliding bush and the first sliding block guide are created. By biasing the tapered first sliding bush towards the tapered inner surface of said first sliding block guide, wear can be compensated and contact between the components can be ensured. The first sliding bush is pushed or pulled into the first sliding block guide along the first direction. Since wear is compensated, a movement of the first primary stage piston can be controlled effectively. The formation of gaps between the first sliding bush and the first sliding block be reduced or avoided. Such gaps generally lead to undesirable noise generation during pump operation. Furthermore, a travel of the piston during operation is constant, resulting in stabile working properties of the pump. Preferably the first tapered end of the first sliding bush is located adjacent to the first tapered end of the first sliding block guide. Preferably, the biasing member is spaced from said inner surface of the first sliding block guide in the first direction. As has been described above, a second axial length of the first sliding bush in said first direction can be larger than a first axial length of said first sliding block guide. Thus, the first sliding bush protrudes from the first inner surface on at least a first end. Preferably the biasing member is located on said first end.

According to a further preferred embodiment said first biasing member applies a first biasing force in a range of larger 0 N to 40 N, preferably 5 N to 30 N, particularly preferred 12 N to 20 N, on said first sliding bush in said first direction.

Moreover, it is preferred that a biasing force, applied by said first biasing member, is substantially symmetrical to said main axis. The amount of friction and wear between said outer surface of the first sliding bush and said inner surface of the first sliding block guide is at least dependent on a contact area, material properties on the inner surface and the outer surface as well as the biasing force applied to the sliding bush. Due to the tapered shape, the biasing force leads to a reaction force perpendicular to the inner surface and/or outer surface. If the biasing force is chosen excessively wear on the first sliding bush and/or the first sliding block guide is increased. By choosing the biasing force in the preferred range, friction and/or wear between said inner surface and said outer surface can be minimized while allowing for constant wear compensation. By applying the biasing force symmetrically, symmetrical wear on the inner surface and/or outer surface can be ensured. Uneven wear might lead to local overloads and result in increased wear, functional loss and/or stability problems of the pump. Preferably, the biasing member pushes said first sliding bush into said first sliding block guide. However, it should be understood that the first biasing force can be a pulling force such that the first sliding bush is pulled into the first sliding block guide.

In a further preferred development of the piston type pump said first biasing member is a spring clip attached to said first sliding block. Preferably, the spring clip comprises a first recess such that the first eccentric and/or the drive shaft can protrude through said recess. The spring clip comprises a biasing section contacting said first sliding bush, wherein the first sliding bush slides along the spring clip parallel to the main axis. It is preferred that the spring clip applies a uniform biasing force to the first sliding bush independently of a relative position of the first sliding bush in the first sliding block guide. Preferably the spring clip covers an opening of said first sliding block guide perpendicular to said inner surface. By attaching said spring clip to the first sliding block guide, a relative movement of the spring clip relative to the first slid block guide is inhibited. Since the spring clip is attached to the first sliding block guide it biases the first sliding bush towards said first end without applying torque on the first sliding block guide. Therefore, a rotation of the first primary stage piston in the first primary stage cylinder is avoided. It is preferred that the spring clip comprises a first hook section engaging a corresponding attachment section of said first sliding block guide. Preferably, the spring clip comprises a second hook section engaging a second corresponding attachment section of said first sliding guide block, wherein the first and second hook sections are formed on opposing ends of said spring clip such that the biasing section is located between the first and second hook section. The spring clip is fixed to the first sliding block guide via the first hook section and/or the second hook section. It is further preferred that the spring clip can be attached to the first sliding block guide in a one-hand operation and/or tool-less operation. By using a spring clip arrangement, a part count of the piston type pump can be reduced. It is also preferred that the spring clip prevents the first sliding bush from slipping out of a second end of said first sliding block guide along said first direction. It should be understood that other methods for fixing the spring clip to the first sliding block guide are also preferred. For example, the spring clip can be attached to the first sliding block guide by screwing, bolting, welding and/or bonding. In a particularly preferred embodiment the spring clip is integrally formed with the sliding block guide.

According to a preferred embodiment said first biasing member is a wave spring, a flat coil, a Belleville washer and/or a wave washer connected to said first eccentric by a first retaining screw. The retaining screw is screwed into a corresponding internal thread of said first eccentric. Furthermore, one or multiple washers can be located between the wave spring, flat coil, Belleville washer and/or wave washer and the first sliding bush and/or between the wave spring, flat coil, Belleville washer and/or wave washer and a screw head of said retaining screw. It is further preferred that the wave spring, flat coil, Belleville washer and/or wave washer is connected to said first eccentric by a first threaded nut screwed to a corresponding external thread of the first eccentric. Again, one or more washers can be located between the biasing member and said threaded nut and/or between the biasing member and the first sliding bush. In this embodiment, the biasing member is not fixed to the first sliding block guide.

Moreover, it is preferred that said first sliding bush comprises an end stop larger than a maximum slot width of said inner surface. Said slot width is measured parallel to the minor axis of the first sliding block guide. Preferably, said slot width is constant in a contacting are of said inner surface, wherein the first sliding bush contacts the first sliding block guide in said contacting area. The end stop can be formed as a protrusion on the first sliding bush extending perpendicular to the first direction. The end stop prevents the first sliding bush from being pushed or pulled entirely through the first sliding block guide by the first biasing member. It is preferred that the first biasing member contacts said end stop. The end stop provides an increased surface area for contacting the biasing member. Surface pressure induced on the first sliding bush by the biasing force decreases and wear on the first sliding bush is reduced.

In a further preferred embodiment said end stop is spaced from a corresponding stop face of said first sliding block guide. Preferably the corresponding stop face is perpendicular to said inner surface of the first sliding block guide. For example, the corresponding stop face and the end stop can be opposing flat surfaces. By spacing the corresponding stop face and the end stop, minimum wear during operation of the piston type pump can be ensured. When wear occurs on the inner surface of the first sliding block guide and the outer surface of the first sliding bush, the first sliding bush is pushed or pulled into the slot. A distance between the end stop and the corresponding stop face is reduced over time until the end stop and the corresponding stop face contact each other. Thus, emergency running characteristics can be ensured. It is preferred that the end stop is spaced from the corresponding stop face of said first sliding block guide by a range of larger 0% to 20% of a length of said inner surface, measured in the first direction. If the outer surface of the first sliding bush and/or the inner surface of the first sliding block guide is worn during operation of the pump, the first sliding bush is pushed or pulled into the first sliding block guide by the biasing member. The end stop is spaced apart from the corresponding stop face such that the first sliding bush can move relative to the first sliding block guide along the first direction. In a worn out state, the end stop contacts the corresponding stop face of said first sliding block guide and prevents the sliding bush from being pushed or pulled entirely through the first sliding block guide. A range of larger 0% to 20% of a length of said inner surface allows for wear compensation possibility and reduced friction while ensuring stable operation and compact design.

Moreover, it is preferred that the drive shaft further comprises a second eccentric, the piston arrangement further comprises a second sliding block guide slidably seated on the second eccentric and wherein a second sliding bush is arranged between the second eccentric and the second sliding block guide. It should be understood that the second eccentric, the second sliding block guide and/or the second sliding bush can have similar properties as described above in respect to the first eccentric, the first sliding block guide and the first sliding block guide. Reference is made to above described features. Preferably the first eccentric and the second eccentric are phase-shifted by 180°.

According to a particularly preferred embodiment, an outer surface of the second sliding bush facing the second sliding block guide is tapered along a second direction towards a second end of said drive shaft, an inner surface of the second sliding block guide corresponding to the outer surface of the second sliding bush is tapered along the second direction towards a second end of said drive shaft. The second end of said drive shaft and the first end of said drive shaft can be located on opposing sides or on the same side of said drive shaft. Preferably, the second sliding bush and the first sliding bush are identical or symmetrical and the first sliding block guide and the second sliding block guide are identical and or symmetrical. Thus, manufacturing cost can be reduced. Preferably, the second sliding bush is biased towards said second end of said drive shaft by a second biasing member, such that said outer surface of the second sliding bush contacts said inner surface of said second sliding block guide. The second biasing member preferably has features as described above for the first biasing member. However, the first biasing member can be formed as a spring clip, while the second biasing member is a wave spring, flat coil, Belleville washer and/or wave washer or vice versa. Forming them identical is particularly preferred to reduce costs.

In a further preferred embodiment a tapered end of said first sliding bush faces a tapered end of said second sliding bush. A tapered end of a sliding bush is oriented in the first direction and reduced in thickness when compared to an opposite end. Preferably the tapered end of said first sliding bush and the tapered end of said second sliding bush are oriented towards a middle section of said drive shaft positioned between the first eccentric and the second eccentric. The first end of the drive shaft and the second end of the drive shaft are opposite ends of the drive shaft. If a first biasing member contacts the first sliding bush on a second end opposite to the tapered end, an assembly process can be improved, since the first biasing member can be assembled after the first sliding bush and the first sliding block guide. In an analogue manner if a second biasing member contacts the second sliding bush on a second end opposite to the tapered end, an assembly process can be improved, since the second biasing member can be assembled after the first sliding bush and the first sliding block guide. A first biasing force applied by a first biasing member and a second biasing force applied by a second biasing member are preferably oriented in opposite directions. Moreover, it is preferred that said first biasing force and said second biasing force are equal.

Preferably the first sliding bush is rotationally fixed to the first sliding block guide. Furthermore, also a second sliding bush can be rotationally fixed to a second sliding block guide. The sliding motion between the first sliding block guide and the first sliding bush and/or between the second sliding block guide and the second sliding bush can be limited to a linear sliding motion. For example, an outer cross-section of the first sliding bush can be substantially rectangular, such that a longer side of the outer cross-section of the first sliding bush is larger than a smaller side of the inner cross-section of the first sliding block guide and/or wherein an inner cross section of the second sliding block guide can be substantially rectangular and a corresponding outer cross-section of the second sliding bush is substantially rectangular such that a longer side of the outer cross-section of the second sliding bush is larger than a smaller side of the inner cross-section of the second sliding block guide.

According to further preferred embodiment the piston arrangement further comprises a first primary stage cylinder formed in the pump housing, in which said first primary stage piston is slidably seated, and a first secondary stage piston being slidably seated in a first secondary stage cylinder formed in the first primary stage piston. Preferably, the first primary stage piston and the first secondary stage cylinder are integrally formed. For example, the first secondary stage cylinder is machined in the first primary stage piston. They are, thus, preferably formed in a one-piece construction. Due to this arrangement, the overall size of the pump can be reduced. The second stage is formed inside the first stage and not adjacent to it or at any other position.

While the first primary stage piston moves relative to the pump housing inside a first primary stage cylinder formed inside the piston housing, the first secondary stage piston moves inside the first primary stage piston.

According to a further preferred embodiment the piston type pump is formed as a so-called twin piston type pump and therefore comprises a second primary stage piston and a second secondary stage piston, wherein the second primary stage piston is slidably seated in a second primary stage cylinder formed in the pump housing, and the second secondary stage piston is slidably seated in a second secondary stage cylinder formed in the second primary stage piston. Depending on how the different cylinders communicate with each other the second primary stage piston may also form a first tertiary stage piston and the second secondary stage piston may form a first quaternary stage piston. In this manner, the piston type pump, which, according to this embodiment, in total includes four pistons, can form a four-stage piston pump. However, particularly preferred is a two stage twin pump which includes two stages, with four pistons and thus a first and second first stage and a first and second secondary stage. As it has been described with respect to the first primary stage piston and the first secondary stage cylinder, also the second primary stage piston and the second secondary stage cylinder preferably are integrally formed, in particular preferred as a one-piece. It is further preferred that the minor axis of the first sliding block guide and the minor axis of the second sliding block guide are parallel to each other. Moreover, it is preferred that a main axis of the first primary stage cylinder and the second primary stage cylinder are coaxial such that the piston type pump is a boxer type pump. Preferably the first secondary stage piston is attached to the second primary stage piston and the second secondary stage piston is attached to the first primary stage piston. Further it is particularly preferred that the first secondary stage piston and the second primary stage piston are integrally formed and the second secondary stage piston and the first primary stage piston are integrally formed.

According to a second aspect, a piston type pump is provided, the piston type pump comprising a pump housing having at least one pump inlet and one pump outlet and a piston arrangement connected to a drive shaft which, when driven, sets the piston arrangement into movement, wherein the drive shaft comprises a first eccentric, and the piston arrangement comprises a first primary stage piston connected to a first sliding block guide slidably seated on the first eccentric, said first sliding block guide having a main axis and a minor axis characterized in that a first rolling bearing is being arranged between the first eccentric and the first sliding block guide, such that translational movement of said first rolling bearing relative to said first sliding block guide is allowed along the main axis and restricted along the minor axis, wherein the piston arrangement further comprises a first primary stage cylinder formed in the pump housing, in which said first primary stage piston is slidably seated, and a first secondary stage piston being slidably seated in a first secondary stage cylinder formed in the first primary stage piston.

According to a third aspect, a vehicle is provided, in particular a passenger car, comprising a piston type pump according to any of the aforementioned preferred embodiments of a piston type pump according to the first aspect or according to the second aspect.

It shall be understood that the pump may also be used in applications other than vehicles, and in particular other than braking systems. Other uses of pumps for generating a vacuum on a vehicle can include engine mounts, compressor waste-gate and bypass valves actuation. This type of pump could also feasibly be used to evacuate a housing for a KERS (Kinetic Energy Recovery System) for example. Furthermore, the pump can be used as a diagnostic pump for an automotive Evaporative Emissions Circuit (EVAP).

For a more complete understanding of the present disclosure, the embodiments of the present disclosure will now be described in detail with reference to the accompanying drawings. The detailed description will illustrate and describe what is considered as a preferred embodiment. It should of course be understood that various modifications and changes in form or detail could readily be made without departing from the spirit of the present disclosure. It is therefore intended that the present disclosure may not be limited to the exact form and detail shown and described herein. The wording "comprising" does not exclude other elements or steps. The word "a" or "an" does not exclude the plurality. The wording "a number of" items comprising also the number 1, i.e. a single item, and further numbers like 2, 3, 4 and so forth. In the accompanying drawings:

A piston type pump 1 according to the present disclosure is suitable to be mounted within a vehicle 100 (see FIG. 12) and used as a vacuum pump to provide vacuum for a braking system or any other consumer in this vehicle. The piston type pump 1 in particular is suitable to be driven by an electric motor which for simplicity is not shown in the drawings.

Figure 11:
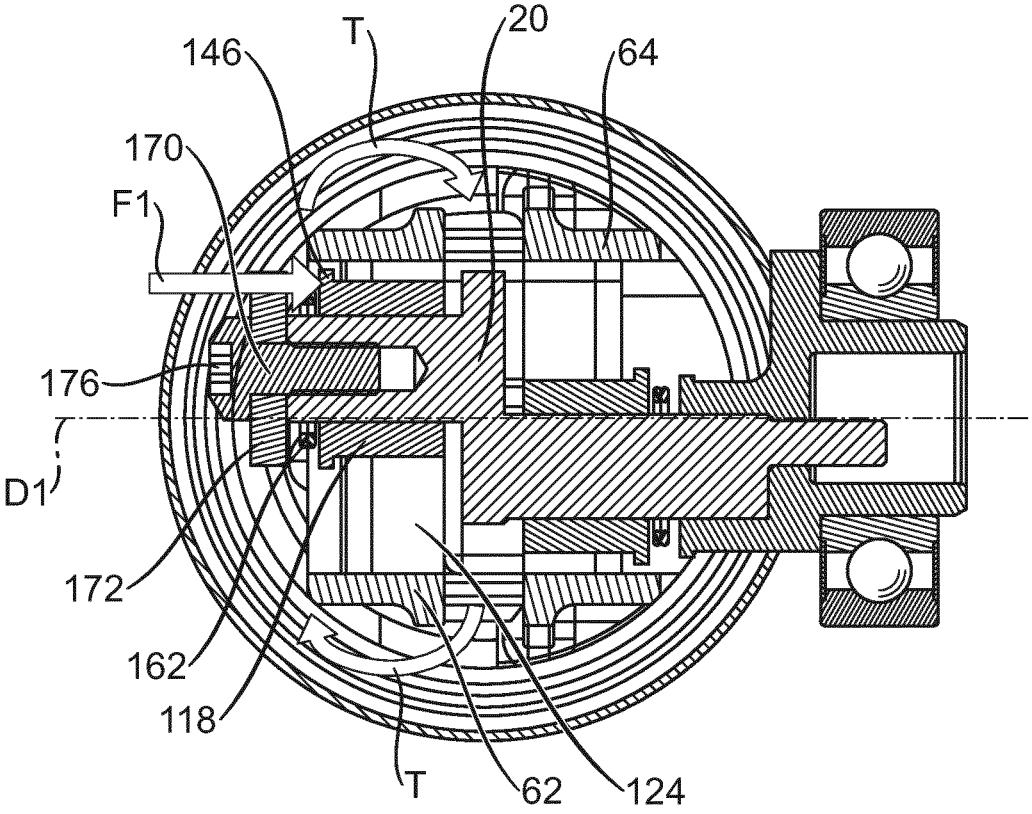
FIG. 11 shows a cut view of the second embodiment at a different angle than FIG. 10.

FIG. 1 shows the piston type pump 1 prepared to be used as a vacuum pump and to induce a vacuum at a pump inlet 4. However, the same construction may also be used as a compressor. The embodiment shown in FIG. 1 to 6 is used to describe possible features of a piston type pump. Possible drive arrangements for a piston type pump are described with reference to FIG. 7 to 11. It should be understood that all combinations of the drive arrangement according to the embodiments shown in FIG. 7 to FIG. 11 with the features of a piston type pump presented with reference to FIG. 1 to 6 are preferred. Furthermore, a piston type pump having different drive arrangements as described according to the embodiments shown in 7 to FIG. 11 for different pistons is preferred.

The piston type pump 1 comprises a pump housing 2 which in the embodiment shown in FIG. 1 substantially is cylindrical. The pump housing 2 has a pump inlet 4 which can be connected to a consumer. Moreover, the pump housing comprises a pump outlet 6 which opens into the environment. The pump outlet 6 is formed as a simple opening in the pump housing 2. Fluid, in particular air, which is drawn away from the pump inlet 4, is not used and only discharged to the environment instead of being provided to any consumer, when the piston type pump 1 is used as a vacuum pump. Within the pump housing 2 a piston arrangement 8 is provided, which will be described in more detail below. The piston arrangement 8 is connected to a drive shaft 10 which, when driven, sets the piston arrangement 8 into movement for inducing a vacuum at the pump inlet in this embodiment. The drive shaft 10 is rotatable about a rotational axis A and may be connected to an electric motor.

The piston arrangement 8 according to the embodiment shown in FIG. 1 comprises a first primary stage piston 12 which is slidably seated in a first primary stage cylinder 14 formed in the pump housing 2. The first primary stage piston 12 in FIG. 1 is shown in its first end position, which is the position furthest away from the rotational axis A, however might travel within the first primary stage cylinder 14 to the left-hand side direction with respect to FIG. 1, thus closer to the rotational axis A.

The piston type pump 1 according to the shown embodiment is formed as a twin type two-stage piston pump and therefore also comprises a first secondary stage piston 16, which is provided within a first secondary stage cylinder 18, which is formed within the first primary stage piston 12. The first primary stage piston 12, therefore, is formed in a hollow manner, to form the first secondary stage cylinder 18. The first primary stage piston 12 comprises a first primary stage piston wall 13 which defines the first secondary stage cylinder 18. The first secondary stage cylinder 18 in particular is formed by an inner circumferential surface of the first primary stage piston wall 13 within the first primary stage piston 12.

In a similar fashion the piston arrangement 8 according to this embodiment also comprises a second primary stage piston 40, which is slidably seated in a second primary stage cylinder 42, which again is formed inside the pump housing 2. The complete interior 3 of the pump housing 2 can be formed as a cylindrical hollow portion to form both, the first primary stage cylinder 14 and the second primary stage cylinder 42.

Also a second secondary stage cylinder 44 is provided which is slidably seated in a second secondary stage cylinder 46 formed within the second primary stage piston 40. Again the second primary stage piston 40 comprises a second primary stage piston wall 41 which defines the second secondary stage cylinder 46 by its inner circumferential surface restricting a second hollow space 47.

Moreover, in FIG. 1 it can be seen that the first primary stage cylinder 14 comprises a first central axis B1 and the second primary stage cylinder 42 comprises a second central axis B2, which are coaxial. Thus, the first and the second central axes B1, B2 form a single axis on which the first primary stage piston 12 and the second primary stage piston 40 move. When the first secondary stage cylinder 18 and the second secondary stage cylinder 46 are formed concentrically within the respective first primary stage piston 12 and the second primary stage piston 40, also the first secondary stage piston 16 and the second secondary stage piston 44 move coaxially with the first and second central axes B1, B2. Thus, the overall design of the piston type pump 1 is a boxer type piston type pump in which the single pistons move in opposing directions. This may lead to a well-balanced design.

The first secondary stage piston 16 comprises a first piston rod 54 which extends through a first assembly opening 60 in the first primary stage piston wall 13. The portion of the hollow space 19 which is on the opposite side of the piston rod 54 with respect to the first secondary piston face 30 can be named the first secondary stage working chamber. In the same manner the second secondary stage piston 44 comprises a second piston rod 56 which extends through a second assembly opening 58 formed in the second primary stage piston wall 41 of the second primary stage piston 40.

Now beginning with FIG. 6, the flow of fluid will be described in more detail.

The pump inlet 4 (see FIG. 6) is here only shown as a single opening which is in fluid connection with a first conduit 74 formed in the pump housing 2. The conduit 74 is surrounded by a protuberance 75 of the pump housing 2, which can be seen in FIG. 1 also. This first conduit 74 substantially extends in a parallel way to the first and second central axes B1, B2. The first conduit 74 on the one hand leads to a second conduit 76 formed in a first housing lid 78 which closes the pump housing 2 and also closes the first primary stage cylinder 14. This second conduit 76 terminates in a first inlet chamber 80 which is closed to the environment by means of a first chamber lid 82. The first inlet chamber 80 comprises a first inlet check valve 84 which allows fluid to flow through the first conduit 74, the second conduit 76, the inlet chamber 80 into the first primary stage cylinder 14, but not vice versa. This is indicated by the arrows in FIG. 6. The first inlet check valve 84 can be formed as a leaf valve and comprises a leaf 86 which is flexible and might be formed out of any flexible material, such as thin metal, elastomer or the like.

A similar arrangement is provided on the other end of the pump housing 2 (see FIG. 1). Even though FIG. 1 is not as detailed as FIG. 6, it shall be understood that the same arrangement is provided. In particular, the pump housing 2 comprises a second housing lid 88 comprising a second inlet chamber 90 with a second inlet check valve 92 and a respective second leaf of the second inlet check valve 92. A third conduit 96 is provided in the second housing lid 88, however, not shown in cut view in FIG. 1, but connected to the first conduit 74 in a similar manner as it has been described with respect to the second conduit 76. Again the second inlet check valve 52 allows fluid to enter the second stage cylinder 46 through the first conduit 74, the third conduit 96, the second inlet chamber 90 and the second inlet check valve 92. The first housing lid 78 and the second housing lid 88 may be formed identical to each other or in a mirrored fashion. In any case manufacturing of the piston type pump 1 is simplified.

When now the drive shaft 10 begins to rotate due to operation of an electric motor attached to the drive shaft 10, the first and second primary stage pistons 12, 40 (see FIG. 1) will move along the respective first and second central axes B1, B2 toward the rotational axis A. Thus, the working chamber, which is formed between the piston housing 2, the respective housing lids 78, 88 and the respective first and second primary stage pistons 12, 40 will be enlarged and therefore fluid will be drawn through the pump inlet 4, the first conduit 74, the second and third conduits 76, 96, the first and the second inlet chambers 80, 90 and the first and second inlet check valves 84, 92. Due to the movement of the first and second primary stage pistons 12, 40 the primary stage vacuum is induced at the pump inlet 4.

When now the drive shaft 10 continues to rotate, the first and second primary stage pistons 12, 40 will again be pushed outwardly, i.e. away from the rotational axis A. The respective first and second working chambers will become smaller and residual fluid, which is in these working chambers, will be compressed. The first and second inlet check valves 84, 92 prevent this fluid from flowing toward the pump inlet 4 again. However, this fluid needs to exit the piston type pump 1. To achieve this, the first primary piston face 24 is provided with a first primary outlet 26 which in turn is provided with a first primary check valve 28. Thus, the fluid contained in the first working chamber can flow through the first primary outlet 26 and the first primary check valve 28 into the first secondary stage cylinder 18.

In the same manner also a second primary piston face 48 of the second primary stage piston 40 is provided with a second primary outlet 50 which in turn is provided with a second primary check valve 52. Thus, fluid contained in the second working chamber may flow through the second primary outlet 50 and the second primary check valve 52 into the second secondary stage cylinder 46 upon movement of the second primary piston 40 away from the rotational axis A.

Both, the first and second primary check valves 28, 52 again might be formed as leaf valves and comprise respective first and second primary check valve leaves 96, 98 which can be identical to leaves 86, 94.

For a more easy manufacturing and assembly, the first primary stage piston face 24 is defined by a first primary stage piston lid 70 attached to the first primary piston wall 13. This first primary stage piston lid 70 carries the first primary check valve 28. Also the second primary stage piston face 48 is defined by a second primary stage piston lid 72 attached to the second primary piston wall 41. This second primary stage piston lid 72 carries the second primary check valve 52.

When the first and second primary stage pistons 12, 40 are in the central position, thus proximal to the rotational axis A, the first and second secondary stage pistons 16, 44 are at the outermost position, thus most distal to the rotational axis A, due to their connection to the first and second eccentrics 20, 21. In this position the first and second secondary stage pistons 16, 44 are proximal to the first and second primary check valves 28, 52 and the respective working chamber is small. Upon rotation of the central drive shaft 10 and movement of the first and second primary stage pistons 12, 40 outwardly, the first and second secondary stage pistons 16, 44 are drawn inwardly toward the rotational axis A, therefore enlarging the respective first and second secondary stage working chambers. A vacuum is induced and additional fluid may flow from the pump inlet 4 through the first and second inlet check valves 84, 92, the first and second primary check valves 28, 52 into the first and second secondary stage working chambers.

On the other hand, when the drive shaft 10 rotates further, the first and second secondary stage pistons 16, 44 are pushed outwardly again, thus decreasing the respective first and second secondary stage working chambers. The fluid, contained in these first and second secondary stage working chambers needs to exit the piston type pump 1.

Figure 3:
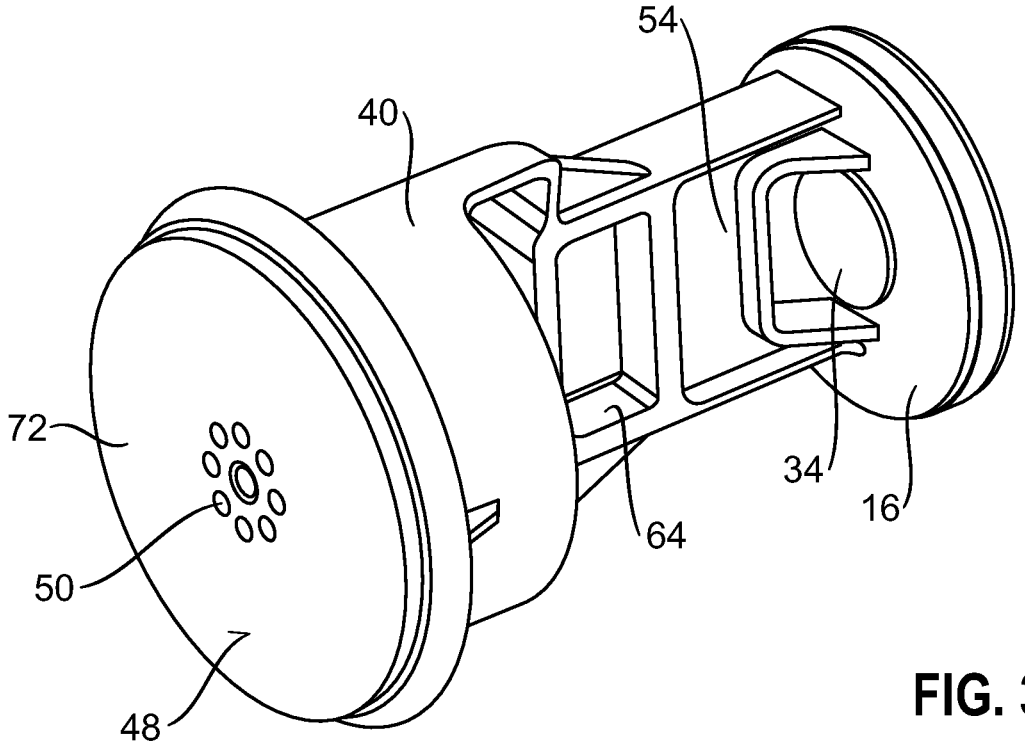
FIG. 3 shows a perspective view of a second primary stage piston and a first secondary stage piston attached together.
Figure 4:
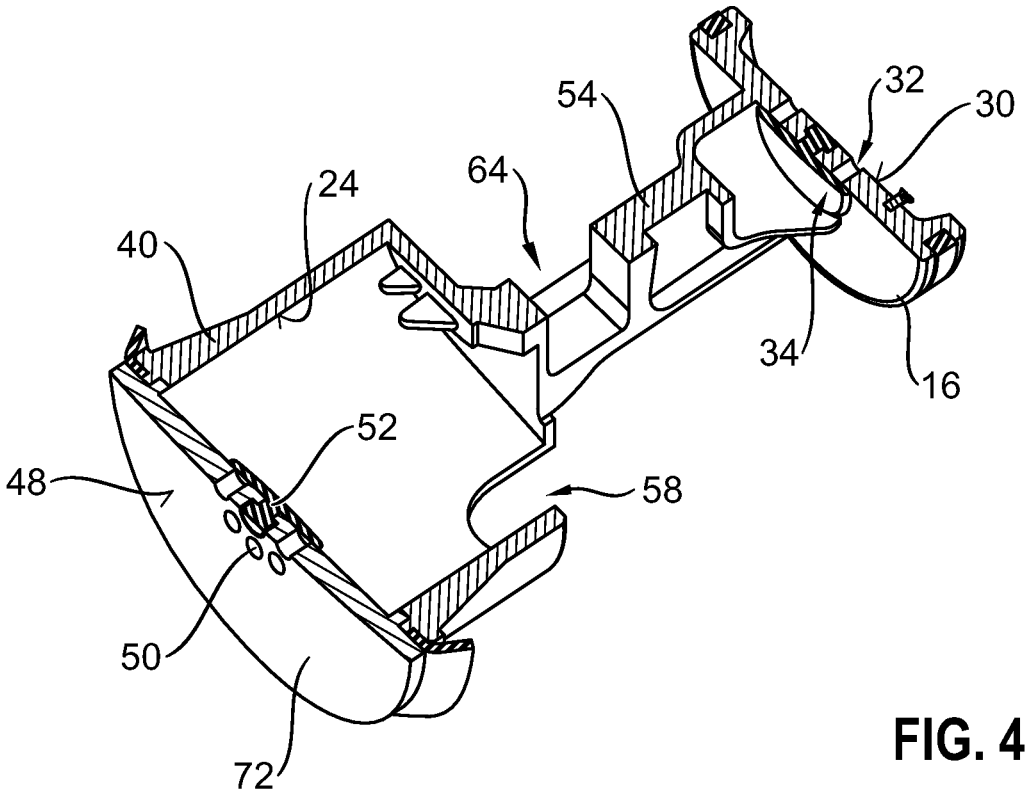
FIG. 4 shows the arrangement of FIG. 3 in a cut view.
Figure 5:
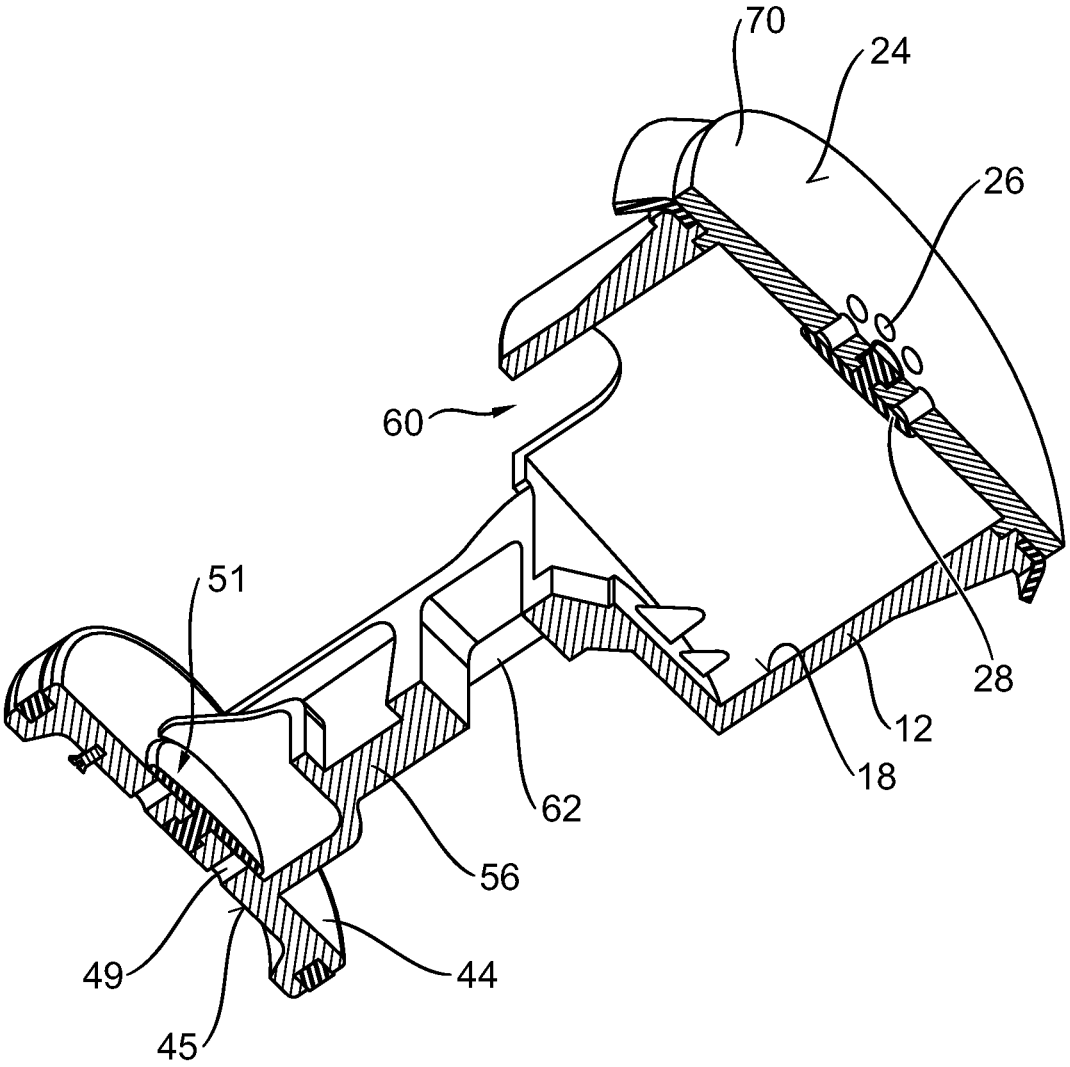
FIG. 5 shows a cut view of a first primary stage piston and a second secondary stage piston attached together.
Figure 6:
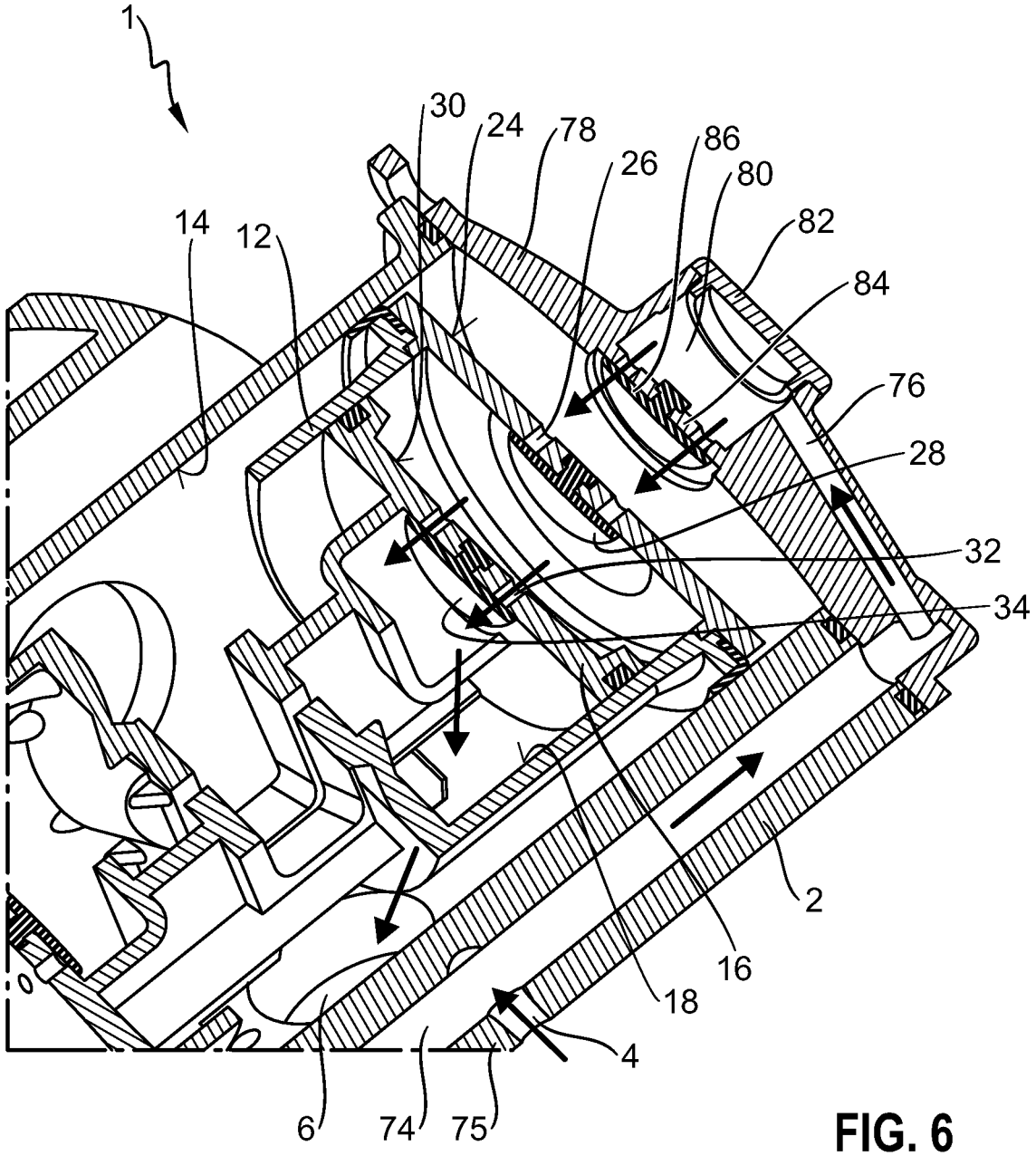
FIG. 6 shows a more detailed cut view of FIG. 1 in the area of the first primary stage piston.

To achieve this, the first secondary piston face 30 is provided with a first secondary outlet 32, which in turn is provided with a first secondary check valve 34 (see FIGS. 3, 4 and 6). As shown in FIG. 6, fluid can pass through this first secondary check valve 34 and out of the pump outlet 6.

In the same manner, also the second secondary stage cylinder 46 is provided with a second secondary outlet 49 in a second secondary piston face 45 and a second secondary check valve 51. Again, fluid may pass through this second secondary check valve 51 and out of the pump outlet 6.

Afterwards, the drive shaft 10 rotates further and again moves the first and second secondary stage pistons 16, 44 toward the rotational axis A. It shall be understood that dependent on how the first, second and third conduits 74, 76, 96 are arranged, also the, for example, first secondary outlet 32 may be guided into the second primary stage working chamber, thus into the second primary stage cylinder 42 and the vacuum may be further decreased. In such an arrangement the piston type pump 1 would be a four stage vacuum pump instead of a two stage twin type vacuum pump as shown in the embodiments in the attached figures.

Figure 7:
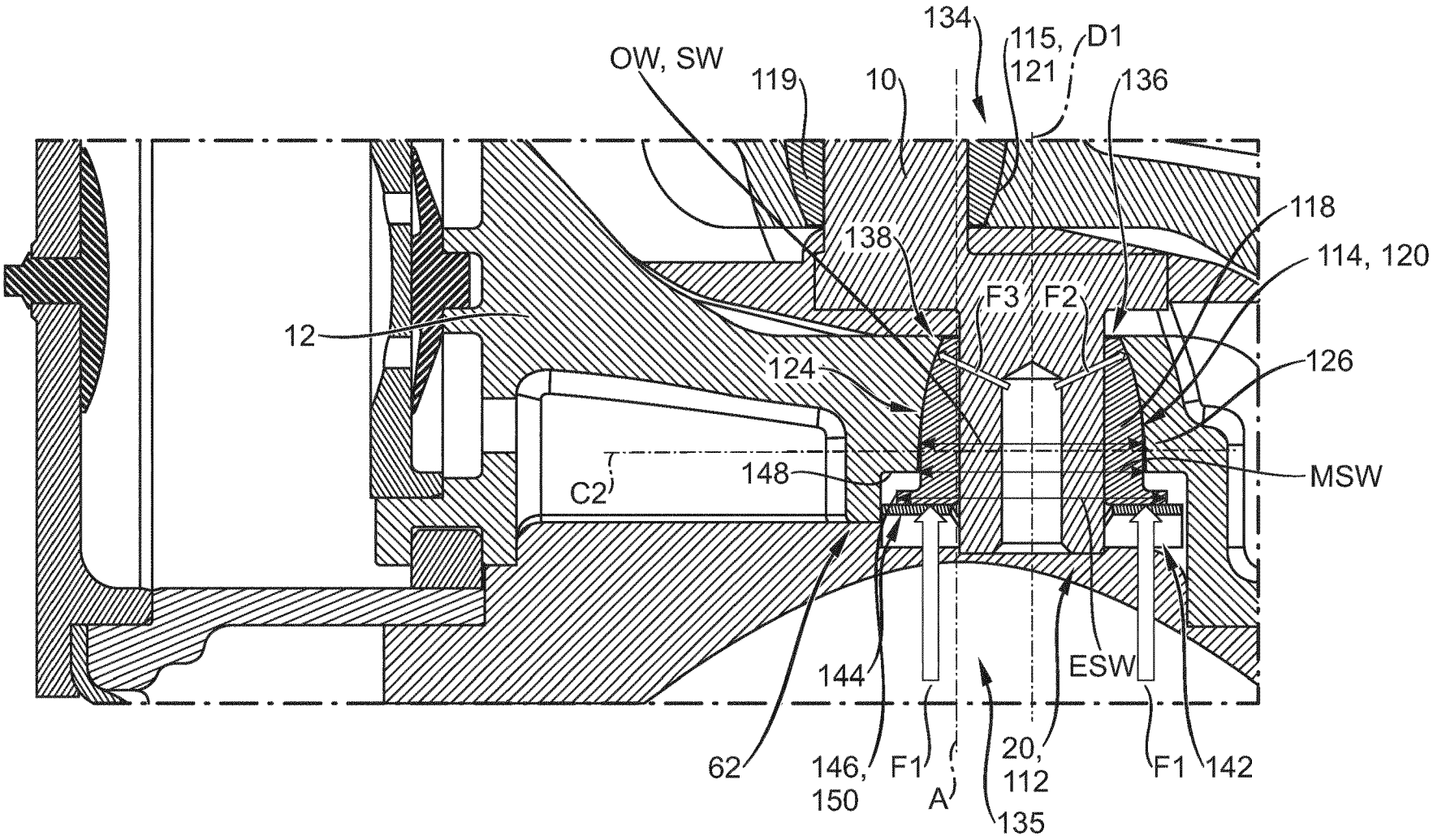
FIG. 7 shows a detailed cut view of a drive arrangement.

Beginning with FIG. 7 the drive assembly according to a first embodiment is explained in more detail. The first primary stage piston 12 is connected to a first sliding block guide 62 seated on a first eccentric 20 of the drive shaft 10. The first eccentric 20 is integrally formed with the drive shaft 10 comprising a first eccentricity e1, measured with respect to the rotational axis A of the drive shaft 10. In this embodiment the first eccentric 20 is formed as a crank pin 112 having a circular cross section. An inner surface 114 of the first sliding block guide 62 forms a slot 116 in the sliding block guide. A first sliding bush 118 is arranged between the first eccentric 20 and the first sliding block guide 62. An outer surface 120 of the first sliding bush 118 is directed towards said inner surface 114 of the first sliding block guide 62. In an analogous manner an outer surface 121 of the second sliding bush 119 is directed towards an inner surface 115 of the second sliding block guide 64. Furthermore, the first sliding bush 118 comprises an inner bore 122 for receiving the first eccentric 20.

Figure 8:
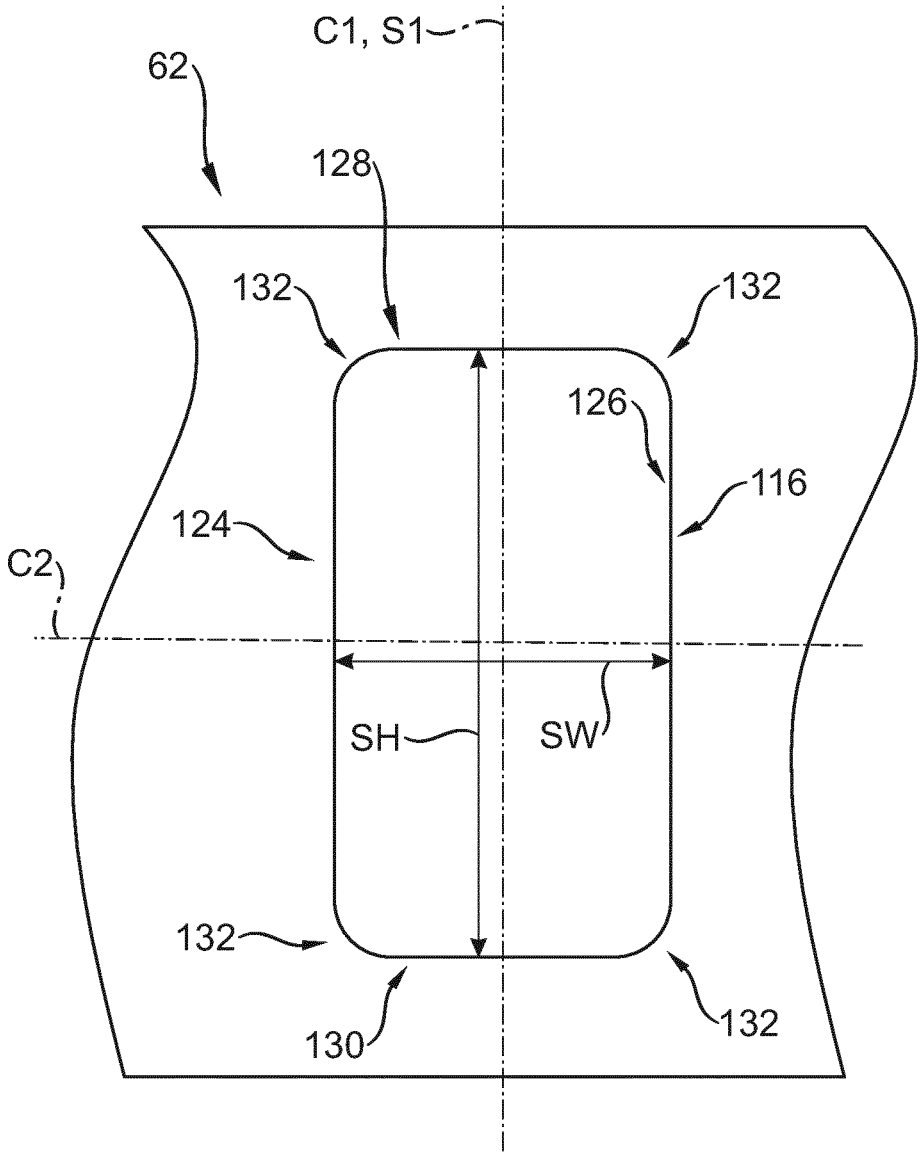
FIG. 8 shows a detail of a slot in the first sliding block guide.
Figure 9:
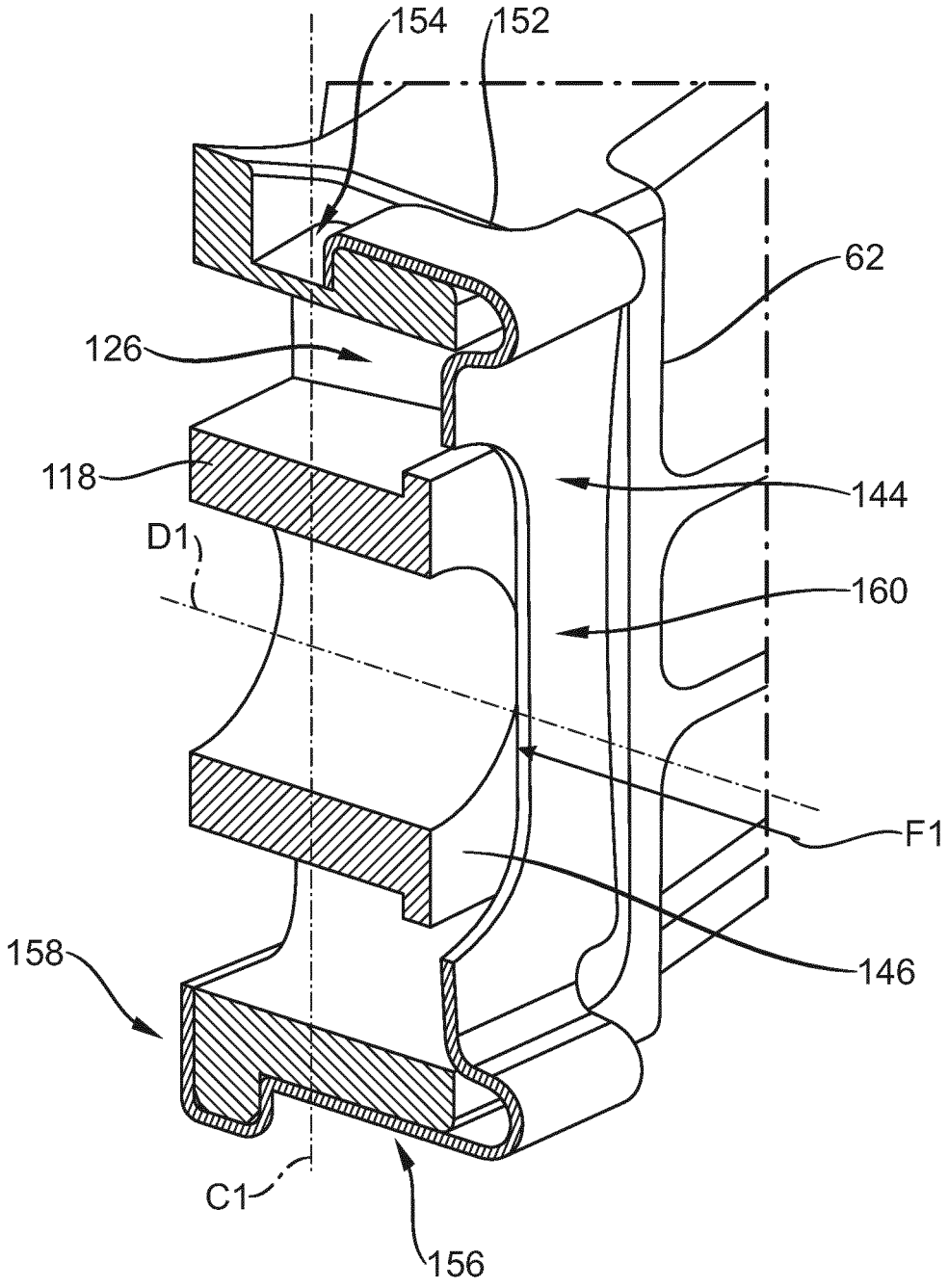
FIG. 9 shows a cut view of the first embodiment perpendicular to the cut view of FIG. 7.
Figure 10:
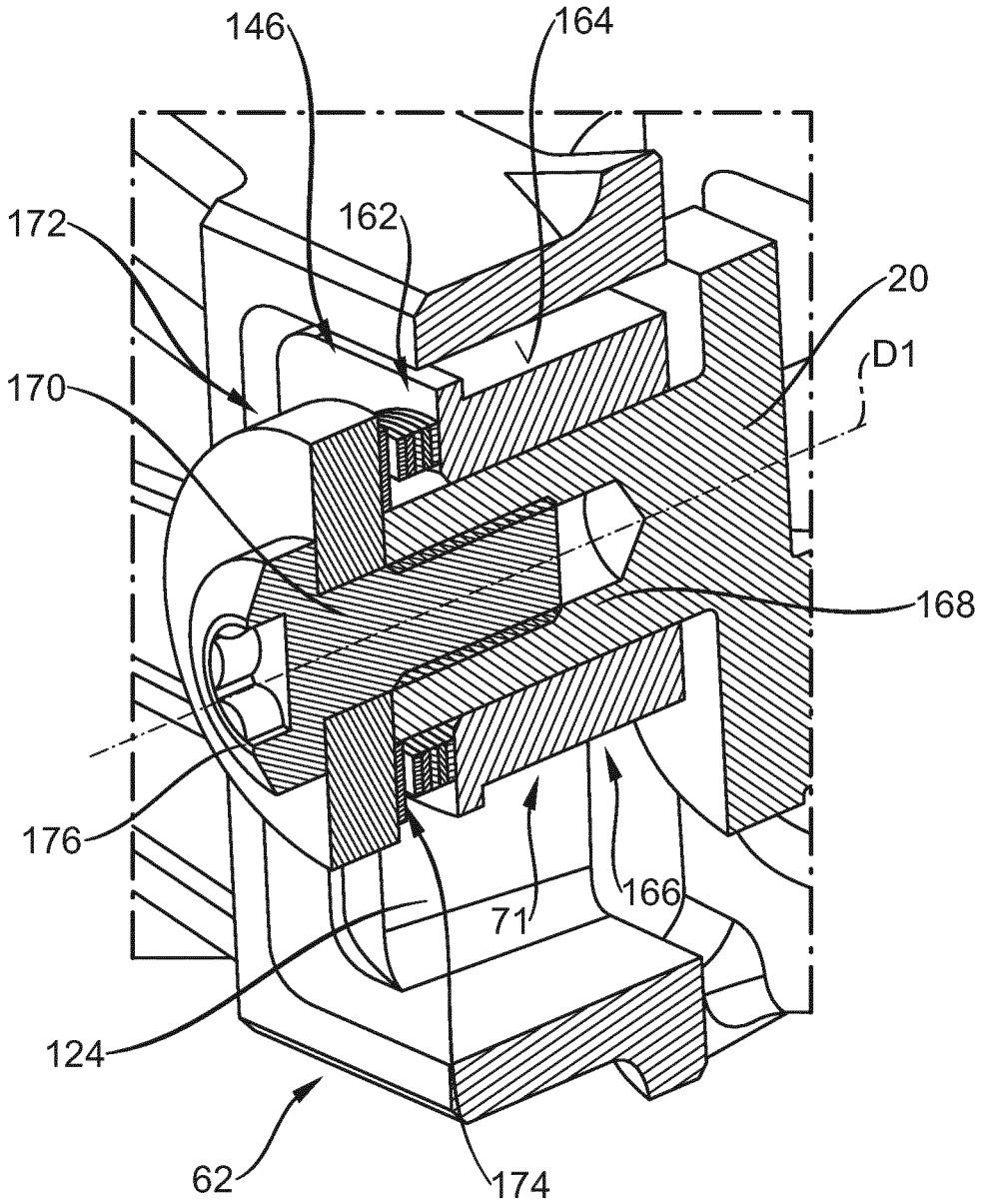
FIG. 10 shows a detailed cut view of a drive arrangement.

A minor axis C2 of the first sliding block guide 62 is perpendicular to a main axis C1 (FIG. 8) and to a first direction D1 (which is perpendicular to the plane of the drawing in FIG. 8). The inner surface 114 comprises a first inner wall 124 parallel to the main axis C1 and a second inner wall 126 parallel to said first inner wall 124. Preferably, the first inner wall 124 and the second inner wall 126 are symmetrical to a first plane S1 which is defined by the main axis C2 and the first direction D1. The first inner wall 124 and the second inner wall 126 are spaced from each other at a slot width SW measured parallel to the minor axis C2. A slot height SH of the slot 116 measured parallel to the main axis C1 is preferably chosen such that the first sliding bush 118 does not contact a third inner wall 128 and a fourth inner wall perpendicular to the first inner wall 124 and the second inner wall 126. Corners 132 of the slot 116 can be rounded or angular. Also, the third and fourth walls 128, 130 may be curved.

According to this embodiment, the inner surface 114 of the first sliding block guide 62 and the outer surface 120 of the first sliding bush 118 are tapered along the first direction D1 towards a first end 134 of the drive shaft 10 (FIG. 7). Here the second sliding bush 119 is tapered towards a second end 135 of the drive shaft 10 in an analogous manner. The inner surface 114 substantially forms a negative of the outer surface 120, such that the first sliding bush 118 contacts the inner surface 114 along the first direction D1. A tapered end 136 of the first sliding bush 118 is located adjacent to a tapered end 138 of the slot 116. An opposite end 140 of the first sliding bush 118, opposite to the tapered end 136, protrudes from the inner surface 114. The outer surface 120 of the first sliding bush 118 is substantially bell shaped in a first cross-section perpendicular to the main axis C1 such that said outer surface 120 is variably tapered in the first direction D1. Preferably, an outer width OW of the first sliding bush 118 is essentially equal to the corresponding slot width SW of the slot 116 along the first direction D1. In a second cross-section perpendicular to the first cross-section the first sliding bush 118 is preferably rectangular such that surfaces of the first sliding bush which are perpendicular to the main axis C1 are parallel to the first direction D1.

A first biasing member 142 applies a biasing force F1 to the first sliding bush 118. Here the first biasing member 142 is formed as a spring clip 144. The spring clip 144 applies the biasing force F1 to an end stop 146 of the first sliding bush 118, which is positioned at the opposite end 140 of the first sliding bush 118. Preferably, the biasing force F1 is parallel to the first direction D1 such that the first sliding bush 118 is pushed into the slot 116. It is further preferred that the biasing force F1 is applied equally to the first sliding bush 118 such that a first reaction force F2 on the first inner wall 124 and a second reaction force F3 on the second inner wall 126 are equal. The end stop 146 of the first sliding bush 118 is spaced from a stop face 148 of the first sliding block guide 62 in the first direction D1. The end stop 146 is formed as a circumferential protrusion 150 or bead of the first sliding bush 118 which has an end stop width ESW that is larger than a maximum slot width MSW of the slot 116 (FIG. 7). Thus, the first sliding bush 118 is prevented from being entirely pushed through the slot 116 when the outer surface 120 and/or the inner surface 114 are worn.

The spring clip 144 comprises a first hook section 152 engaging a first attachment section 154 of the first sliding block guide 62 and a second hook section 156 engaging a second attachment section 158 of the first sliding block guide 62. The first hook section 152 and the second hook section 156 are arranged such that even when the biasing force F1 is applied by the spring clip 144, the spring clip 144 is fixed to the first sliding block guide 62. In this embodiment the first attachment section 154 and the second attachment section 158 are formed as planes perpendicular to the first direction D1. Preferably, the first hook section 152 and the second hook section 156 are formed on opposing ends of the spring clip 144 while a biasing section 160 is positioned in between the hook sections 152, 156. The biasing section 160 contacts the end stop 146 of the first sliding bush 118. Furthermore, the biasing section 160 covers the slot 116 such that the first sliding bush 118 is prevented from slipping out of the slot 116.

When the drive shaft 10 is rotated about the rotational axis A, the first eccentric 20 performs an orbital movement around said rotational axis A. Since the first sliding bush 118 is located on the first eccentric 20 said orbital movement is transferred to said first sliding bush 118. The first sliding bush 118 is rotationally fixed within the first sliding block guide 62 such that the first eccentric 20 rotates relative to first sliding bush 118 in the inner bore 122 and only translational movement is transferred to the first sliding block guide 62. The orbital movement comprises a first component parallel to the main axis C1 and a second component parallel to the minor axis C2. It should be understood that since the first eccentric 20 performs an orbital movement, movements parallel to the main axis C1 and parallel to the minor axis C2 occur simultaneously. If a component of the orbital movement along the main axis C1 is transferred to the first sliding bush 118, said first sliding bush 118 slides relative to the first sliding block guide 62 along the main axis C1 and no movement is transferred to the first sliding block guide 62. Since the outer surface 120 of the first sliding bush 118 contacts the first inner wall 124 and the second inner wall 126 of the first sliding block guide 62, translational movement of said first sliding bush 118 relative to said first sliding block guide 62 is not possible along the minor axis C2. Thus, the component of said orbital movement of the first eccentric 20 parallel to the minor axis C2 is transferred to the first sliding block guide 62 via the first sliding bush 118. The orbital movement of the first eccentric 20 is transformed into a rectilinear movement of the first sliding block guide 62 along its minor axis C2.

In a second embodiment (see FIG. 10) the first sliding bush 118 is biased towards the first sliding block guide 62 by a wave spring 162. Again, the outer surface 120 (not shown in FIG. 10) of the first sliding bush 118 and the inner surface 114 of the first sliding block guide 62 are tapered in the first direction D1. An upper surface 164 and a lower surface 166 of the outer surface 120 of said sliding bush 118 are parallel to each other and to the first direction D1. The wave spring 162 is positioned at the end stop 146 and evenly applies the biasing force F1. First eccentric 20 comprises an internal thread 168 which corresponds to a retaining screw 170. Said retaining screw 170 is screwed into the internal thread 168 and fixes the wave spring 162 to the first eccentric 20. A thrust washer 172 and a slip washer 174 are arranged between a screw head 176 of said retaining screw 170 and the wave spring 162. The thrust washer 172 is positioned adjacent to the screw head 176 and has a larger outer diameter than said screw head 176. Using a thrust washer 172 it is possible to use a standardized screw as retaining screw 170 while allowing for adequate material thickness of the first eccentric 20. The wave spring 162 acts against the thrust washer 172 and imparts a torque T (indicated by arrows in FIG. 11) to the first sliding block guide 62 via the first sliding bush 118. Such a torque is absent in the arrangement according to the first embodiment as presented in FIG. 7 to FIG. 9.

During operation the first eccentric 20 rotates inside the inner bore 122 of the first sliding bush 118 while the retaining screw 170 is fixed to the first eccentric 20. Relative motion between a first opposing end 178 and a second opposing end 180 of the wave spring 162 might cause damage to said wave spring 162 and/or change the biasing force F1. The slip washer 174 allows for relative rotational movement between said slip washer 174 and the thrust washer 172 about and parallel to the first direction D1. During operation the screw head 176 and the thrust washer 172 rotate in the first sliding bush while the slip washer 174 slips relative to said thrust washer 172. Thus, torsional forces on the wave spring 162 are avoided.

It should be understood that the second eccentric 22, second sliding block guide 64 and a second sliding bush 119 can have similar features as described regarding the first eccentric 20, the first sliding block guide 62 and the first sliding bush 118.

Figure 12:
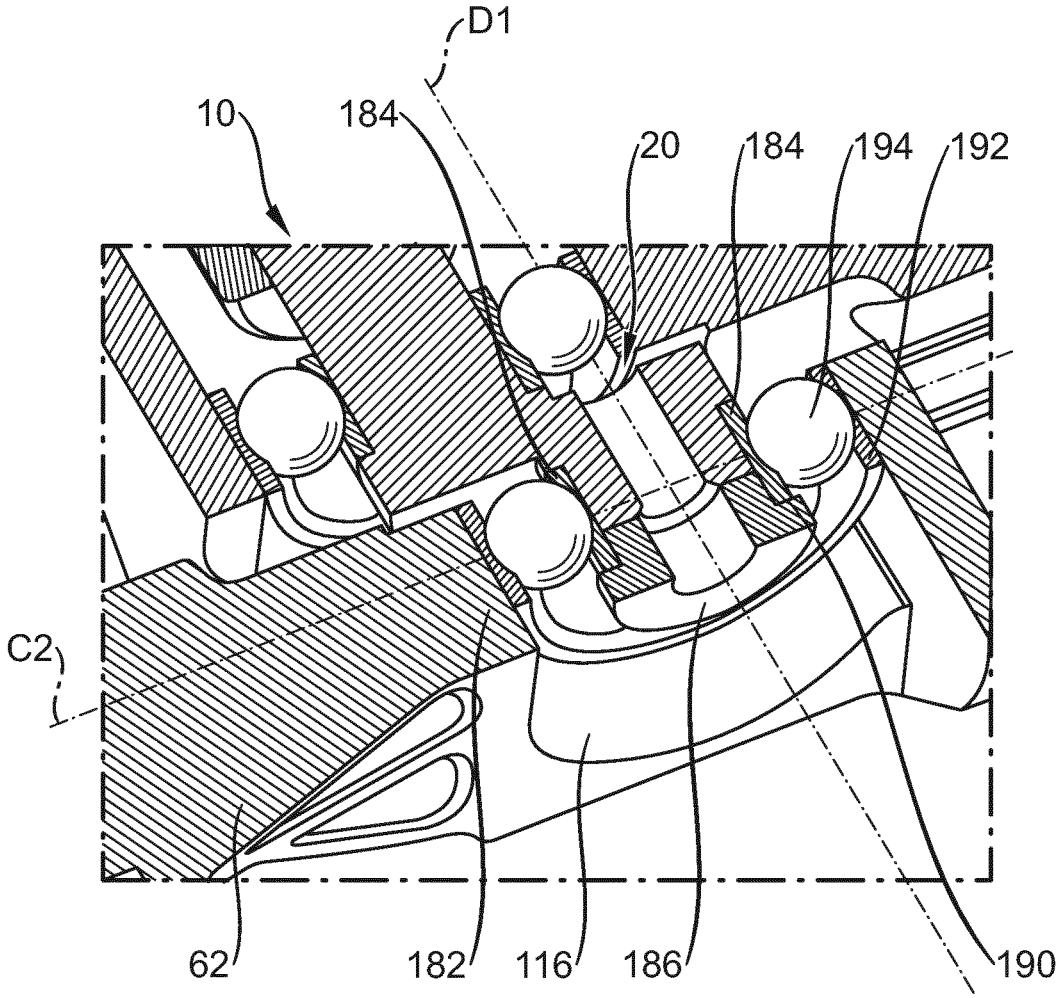
FIG. 12 shows a detailed cut view of a drive arrangement according to a third embodiment.

With reference to FIG. 12 a third embodiment of a piston type pump 1 is described. Elements that are similar or identical to other embodiments have the same reference numerals used in the previous figures. Again, all features described with reference to FIG. 1 to FIG. 6 can be present in this embodiment. The drive shaft 10 comprises a first eccentric 20 which is located in a slot 116 of a first sliding block guide 62. In this embodiment a rolling bearing 182 is located between the first eccentric 20 and the first sliding block 62. It shall be understood that the rolling bearing 182 can be one of: roller bearing, needle roller bearing, barrel roller bearing and/or any other type of rolling bearing. An inner ring 184 of the rolling bearing 182 is fixed to the first eccentric 20 via a fixing member 186. Preferably, the fixing member 186 is screwed to the first eccentric 20 via a fixing screw (not shown in FIG. 12). For fixing the inner ring 184 of the rolling bearing 182 the first eccentric 20 comprises a first bearing stop face 188 and the fixing member 186 comprises a second bearing stop face 190. The first bearing stop face 188 protrudes perpendicular to the first direction D1. In an analogous manner the second bearing stop face 188 protrudes perpendicular to the first direction D1. The inner ring 184 of the rolling bearing 182 is fixed between the first bearing stop face 188 and the second bearing stop face 190. An outer ring 192 of the rolling bearing 182 is positioned adjacent to the inner surface 114 of the first sliding block guide 62 and slidable to said inner surface 114. During operation drive shaft 10 is driven and eccentric 20 as well as the inner ring 184 of said rolling bearing 182 perform an orbital movement around the rotational axis A. The outer ring 192 is rotatable supported relative to the inner ring 184 around the first direction D1 by multiple rollers 194 (shown schematically in FIG. 12). Thus, wear on the first eccentric 20 can be reduced. With respect to FIG. 12 the outer ring 192 of the rolling bearing 182 slides up and down in said slot 116 of the first sliding block guide 62. A motion of the first eccentric 20 along the minor axis C2 is transferred to the first sliding block guide by the rolling bearing 182 such that a pendulum motion of the first primary stage piston 12 is eliminated. Preferably, the outer ring 192 of said rolling bearing 182 and/or the inner surface 114 of said sliding block guide 62 are made of a highly wear resistant material. Preferably, the inner surface 114 and/or the outer ring 192 are hardened.

Figure 13:
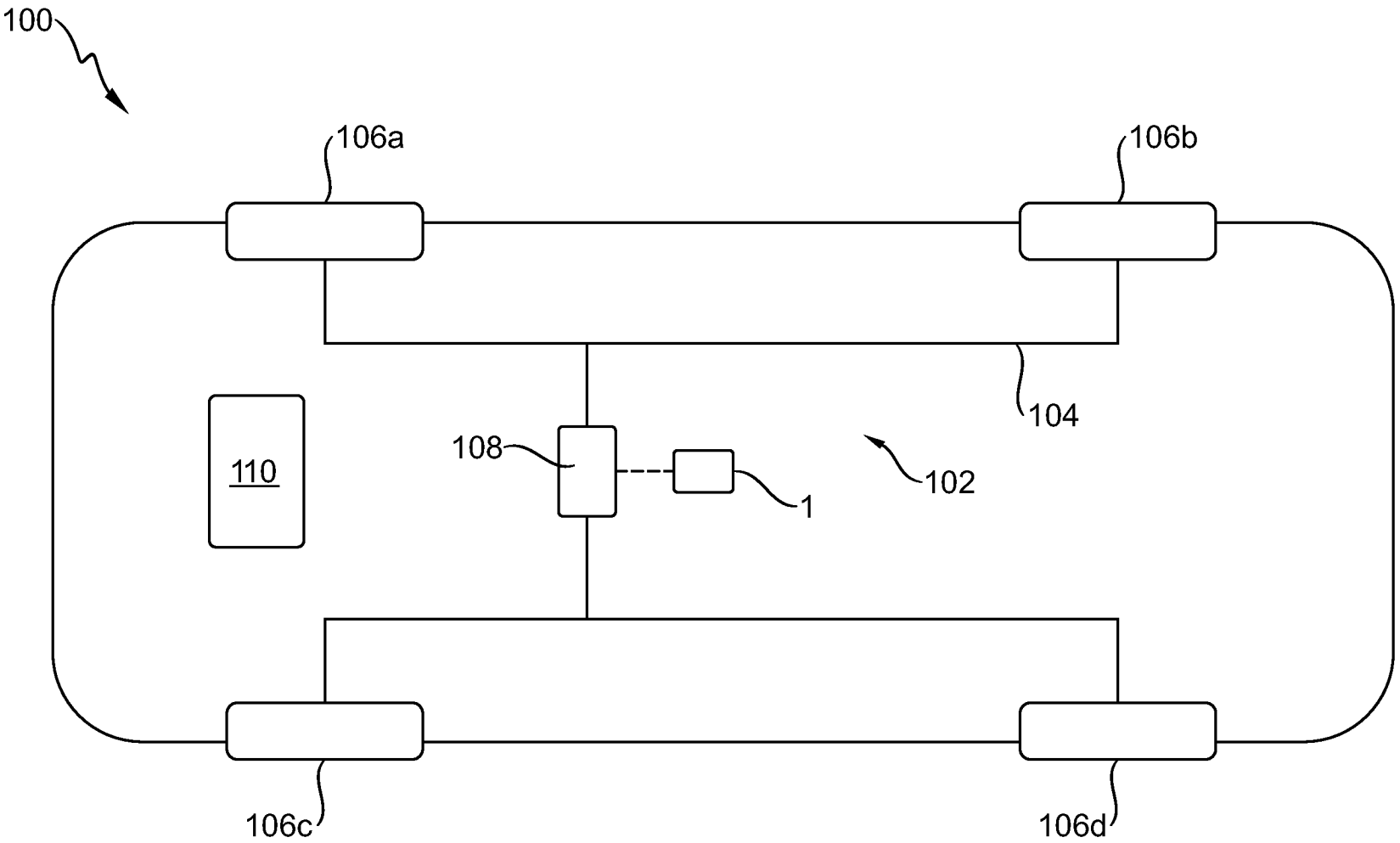
FIG. 13 shows a schematic view of a vehicle.

FIG. 13 now depicts a schematic drawing of a vehicle 100. Vehicle 100 preferably is formed as a passenger car, or a light truck and comprises a pneumatic braking system 102. The braking system 102 is shown by lines 104 leading to wheels 106*a*, 106*b*, 106*c*, 106*d* for providing the wheels 106*a*, 106*b*, 106*c*, 106*d* with the respective braking pressure. Lines 104 are connected to a central module 108. The vehicle 100 moreover comprises an engine 110 and a piston type pump 1, which is herein used as a vacuum pump 1. piston type pump 1 provides the braking system 102 with vacuum, which e.g. could be used by a brake booster of the braking system 102, which could be implemented in the central module 108.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE CHARACTERS

1 piston type pump
2 pump housing
3 interior
4 pump inlet
6 pump outlet
8 piston arrangement
10 drive shaft
12 first primary stage piston
13 first primary stage piston wall
14 first primary stage cylinder
16 first secondary stage piston
18 first secondary stage cylinder
19 hollow space
20 first eccentric
22 second eccentric
24 first primary piston face
26 first primary outlet
28 first primary check valve
30 first secondary piston face
32 first secondary stage piston outlet
34 first secondary check valve
40 second primary stage piston
41 second primary stage piston wall
42 second primary stage cylinder
44 second secondary stage piston
45 second secondary piston face
46 second secondary stage cylinder
47 second hollow space
48 second primary piston face
49 second secondary outlet
50 second primary outlet
51 second secondary check valve
52 second primary check valve
54 first piston rod
56 second piston rod
58 second assembly opening
60 first assembly opening
62 first sliding block guide
64 second sliding block guide
70 first piston lid
72 second primary stage piston lid
74 first conduit
75 protuberance
76 second conduit
78 first housing lid
80 first inlet chamber
82 first chamber lid
84 first inlet check valve
86, 94 leaf
88 second housing lid
90 second inlet chamber
92 second inlet check valve
96 third conduit
100 vehicle
102 pneumatic braking system
104 lines
106*a*, 106*b*, 106*c*, wheels
108 central module
110 engine
112 crank pin
114 inner surface
115 inner surface (second sliding block
116 slot
118 first sliding bush
119 second sliding bush
120 outer surface
121 outer surface (second sliding bush)
122 inner bore
124 first inner wall
126 second inner wall
128 third inner wall
130 fourth inner wall
132 corner
134 first end (drive shaft)
135 second end (drive shaft)
136 tapered end (first sliding bush)
138 tapered end (slot)
140 opposite end
142 first biasing member
144 spring clip
146 end stop

148 stop face
150 protrusion
152 first hook section
154 first attachment section
156 second hook section
158 second attachment section
160 biasing section
162 wave spring
164 upper surface
166 lower surface
168 internal thread
170 retaining screw
172 thrust washer
174 slip washer
176 screw head
178 first opposing end
180 second opposing end
182 rolling bearing
184 inner ring
186 fixing member
188 first bearing stop face
190 second bearing stop face
192 outer ring
194 roller
e1 first eccentricity
e2 second eccentricity
A rotational axis
B1 first central axis
B2 second central axis
C1 main axis
C2 minor axis
D1 first direction
ESW end stop width
F1 biasing force
F2 first reaction force
F3 second reaction force
MSW maximum slot width
OW outer width
S1 first plane
SW slot width
SH slot height
T torque

The invention claimed is:

1. A piston type pump, comprising:

a pump housing having a pump inlet, a pump outlet, and a piston arrangement connected to a drive shaft, the drive shaft being configured to drive the piston arrangement, the drive shaft comprising a first eccentric, the piston arrangement having a first primary stage piston connected to a first sliding block guide slidably seated on the first eccentric, the first sliding block guide having a main axis, a minor axis, and an inner surface, wherein a first sliding bush is arranged between the first eccentric and the first sliding block guide, wherein an outer surface of the first sliding bush corresponds to the inner surface of the first sliding block guide and a translational movement of the first sliding bush relative to the first sliding block guide is allowed along the main axis and restricted along the minor axis, wherein the outer surface of the first sliding bush is tapered along a first direction that is parallel to a rotational axis of the drive shaft towards a first end of the drive shaft, and wherein the inner surface of the first sliding block guide is correspondingly tapered along the first direction towards the first end of the drive shaft.

2. The piston type pump according to claim 1, wherein the first sliding bush is biased towards the first end of the drive shaft by a first biasing member such that the outer surface of the first sliding bush contacts the inner surface of the first sliding block guide.

3. The piston type pump according to claim 2, wherein the first biasing member applies a first biasing force in a range of larger 0 N to 40 N on the first sliding bush in the first direction that is parallel to the rotational axis of the drive shaft.

4. The piston type pump according to claim 2, wherein the first biasing member is a spring clip attached to the first sliding block guide.

5. The piston type pump according to claim 2, wherein the first biasing member is one of a wave spring, a flat coil, a Belleville washer and/or a wave washer that is connected to the first eccentric by a first retaining screw.

6. The piston type pump according to claim 2, wherein the first sliding bush comprises an end stop that is larger than a maximum slot width of the inner surface of the first sliding block guide.

7. The piston type pump according to claim 6, wherein the end stop is spaced from a corresponding stop face of the first sliding block guide.

8. The piston type pump according to claim 1, wherein the drive shaft further comprises a second eccentric, wherein the piston arrangement further comprises a second sliding block guide slidably seated on the second eccentric, and wherein a second sliding bush is arranged between the second eccentric and the second sliding block guide.

9. The piston type pump according to claim 8, wherein an outer surface of the second sliding bush facing the second sliding block guide is tapered along a second direction towards a second end of the drive shaft, and wherein an inner surface of the second sliding block guide corresponding to the outer surface of the second sliding bush is tapered along the second direction towards a second end of the drive shaft.

10. The piston type pump according to claim 8, wherein a tapered end of the first sliding bush faces a tapered end of the second sliding bush.

11. The piston type pump according to claim 1, wherein the first sliding bush is rotationally fixed to the first sliding block guide.

12. The piston type pump according to claim 1, wherein the piston arrangement further comprises a first primary stage cylinder formed in the pump housing, wherein the first primary stage piston is slidably seated in the first primary stage cylinder, and a first secondary stage piston being slidably seated in a first secondary stage cylinder formed in the first primary stage piston.

13. A vehicle comprising the piston type pump according to claim 1.

* * * * *